US007788803B2

(12) United States Patent
King, Jr. et al.

(10) Patent No.: US 7,788,803 B2
(45) Date of Patent: Sep. 7, 2010

(54) METHOD OF MAKING A TWIST-ON WIRE CONNECTOR

(76) Inventors: Lloyd Herbert King, Jr., 394 Larimore Valley Dr., Chesterfield, MO (US) 63005; Michael Belgeri, 1007 Bridgeport, Ellisville, MO (US) 63011; James Keeven, 2641 Whitetail La., O'Fallon, MO (US) 63366; William Hiner, 8 Briarcastle Ct., O'Fallon, MO (US) 63366

( * ) Notice: Subject to any disclaimer, the term of this patent is extended or adjusted under 35 U.S.C. 154(b) by 18 days.

(21) Appl. No.: 11/903,897

(22) Filed: Sep. 25, 2007

(65) Prior Publication Data

US 2008/0073103 A1 Mar. 27, 2008

Related U.S. Application Data

(62) Division of application No. 11/346,402, filed on Feb. 1, 2006, now abandoned.

(60) Provisional application No. 60/653,215, filed on Feb. 15, 2005.

(51) Int. Cl.
*H01R 43/00* (2006.01)

(52) U.S. Cl. ..... 29/883; 29/874; 29/878

(58) Field of Classification Search ..... 29/874–878, 29/883; 174/87
See application file for complete search history.

(56) References Cited

U.S. PATENT DOCUMENTS

| | | | | |
|---|---|---|---|---|
| 3,676,574 | A * | 7/1972 | Johansson et al. | 174/87 |
| 4,104,482 | A * | 8/1978 | Scott | 174/87 |
| 5,113,037 | A * | 5/1992 | King et al. | 174/87 |
| 5,151,239 | A * | 9/1992 | King, Jr. | 264/272.11 |
| 5,441,560 | A * | 8/1995 | Chiotis et al. | 106/18.12 |
| 6,359,226 | B1 * | 3/2002 | Biddell et al. | 174/74 A |
| 6,730,847 | B1 * | 5/2004 | Fitzgerald et al. | 174/77 R |
| 7,086,150 | B2 * | 8/2006 | King et al. | 29/883 |
| 7,351,369 | B2 * | 4/2008 | King, Jr. | 264/294 |
| 2004/0104039 | A1 * | 6/2004 | Herbert King, Jr. | 174/87 |
| 2008/0073103 | A1 * | 3/2008 | King et al. | 174/87 |

* cited by examiner

*Primary Examiner*—C. J Arbes
(74) *Attorney, Agent, or Firm*—Jacobson & Johnson

(57) ABSTRACT

A twist-on wire connector containing a mass of a cohering gel in a gel state therein for forming a protective covering over a wire connection in the twist-on wire connector with the gel thereon removal from the twist-on wire connector and peelable from the wire connection to enable one to quickly form a further wire connection without having to wipe off the wire connection.

9 Claims, 3 Drawing Sheets

METHOD OF MAKING A TWIST-ON WIRE CONNECTOR

CROSS REFERENCE TO RELATED APPLICATIONS

This application is a division of application Ser. No. 11/346,402 filed Feb. 1, 2006 now abandoned titled Twist-on Wire Connector with Peelable Covering, which claims priority from provisional patent application 60/653,215 filed Feb. 15, 2005 titled Twist-on Wire Connector.

FIELD OF THE INVENTION

This invention relates generally to twist-on wire connectors and, more specifically, to twist-on wire connectors carrying a gel in a gel state therein for forming a protective covering around a wire connection yet allowing the user to quickly strip the protective covering from the wire if the wire connection needs to reformed.

STATEMENT REGARDING FEDERALLY SPONSORED RESEARCH OR DEVELOPMENT

None

REFERENCE TO A MICROFICHE APPENDIX

None

BACKGROUND OF THE INVENTION

Wire connectors that connect two or more electrical wires together are widely known and used because of convenience and the ability to quickly form a low resistance electrical connection between two or more wires. Generally, there are two categories of wire connectors, twist-on wire connectors and non twist-on wire connectors.

Typically, a twist-on wire connector has spiral thread inside an electrically insulated housing. By inserting the ends of wires into the spiral thread and rotating the twist-on wire connector housing one can quickly bring the electrical wires into a low resistance electrical connection with each other without the aid of tools. Generally, there are two types of twist-on connectors, one, which contain no substances in the twist-on wire connector, and those that contain a substance in the twist-on wire connector. The twist-on wire connectors without any substances are advantageous when it comes to rewiring or reforming a wire connection in that they allow a user to disengage the wires in the twist-on wire connector and quickly form one or more of the wires in a fresh connection with one or more wires. On the other hand, the wires in the twist-on wire connector without a substance such as a protective sealant, if exposed to moisture, can result in a failed connection. Some twist-on wire connectors carry a sticky sealant to overcome the moisture problem but these twist-on wire connectors are generally more time consuming to use when a wire connection needs to be rewired or reformed since to reconnect wires that have been encased in a sticky sealant care must be taken to first remove the sticky sealant from the wires before a reconnection is attempted. Failure to do so can result not only in getting sticky sealant on the user but on other portions of the electrical system.

A feature of the invention is that the wire ends do not have to be wiped free if someone wants to remove the wires from the connector to test one or more of the circuits associated with the wires. This allows the wires to be reinserted after the testing complete. In some case no new gel is needed thus making the twist-on connector with the gel reusable.

Still other twist-on wire connectors contain a substance such as solidifying agent, for example an epoxy, which cures to forms a solid enclosure around the wire ends in the twist-on wire connectors. While these twist-on wire connectors provide for a solid encapsulation of the wire ends they do not allow for quick reforming or rewiring of a wire connection since the wires cannot generally be removed from the solidified epoxy in the twist-on wire connector. To rewire these type of twist-on wire connectors the wires need to be cut free of the twist-on wire connector and the wire ends then need to be stripped of insulation to expose the wire ends for forming a new wire connection. Also a time consuming process.

In regard to the category of non twist-on wire connectors gels, and other sealants have been used to cover wire connections to prevent moisture from entering the wire connector. For example, gels are used in socket type electrical connectors. Typically, to apply a gel to an electrical connector the gel is placed in a connector and squeezed or compressed around the electrical connection in order to force the gel to cover the wire ends in the electrical connector. Generally, squeezing the gel around an electrical connection is found in connectors that have two parts, one part that usually snaps into another part. This type of compression sealing around the wire ends can be found in socket type connectors that have blade like elements for engaging a wire end.

To maintain a water proof or water resistant connection in the art of twist-on wire connectors it is proposed to use a viscous sealant which remains in a sticky condition on the wire ends. The sticky sealant is first placed on the spiral threads of the twist-on wire connector. The wires are then twisted into a low resistance electrical connection in the presence of the sticky sealant, which results in forming a protective covering over the wire ends. These type of twist-on wire connectors can generally in one step form a protective covering over the wire ends that form the wire connection. However, these type of twist-on wire connectors that use a sticky sealant require cleaning of the wires each time a wire connection needs to be reformed.

The type of twist-on wire connectors where a viscous sealant covered electrical connection is formed insitu in the twist-on wire connectors are disclosed in King U.S. Pat. Nos. 5,151,239; 5,113,037; 5,023,402 and Re 37,340 which show a twist-on wire connector that allows on-the-go formation of a sealant covered electrical connection.

The Simmons U.S. Pat. No. 6,025,559 discloses another type of a wire connector using a viscous sealant and a tubular housing having a twist-on wire connector where the wires are twisted into a coil and the wires and the wire holder are forced into a sealant located at the end of the tubular housing.

In one embodiment of the socket type connectors a tubular form (shown in King U.S. Pat. No. 6,051,791) a two part connector containing a connector is made in a shoe and the shoe with the electrical connector is forced into a tubular member containing a sealant.

Other examples of non-twist-on wire connector assemblies or socket type wire connectors include the following patents which instead of using a viscous sealant disclose some type of wire connector wherein the wire connection is protected with some type of waterproof covering.

U.S. Pat. No. 6,494,737 discloses an example of a wire connector block wherein silicon gel is injected into the enclosed space of the wire connector block to provide a wire connector that is resistant to the passage of moisture.

U.S. Pat. No. 6,475,029 discloses another example of a wire connector assembly when an uncured gel material is poured into the cavities and passageways of a socket and the uncured gel material is then cured to form a gel over the tines in the socket.

U.S. Pat. No. 6,478,606 discloses a twist-on wire connector having a heat shrinkable skirt or sleeve that is attached to the shell of the twist-on wire connector. When heat is applied to the skirt surrounding the insulation on the wires the heat shrinkable skirt is brought into shrink contact with the insulation covering on the electrical wires that extend into the twist-on wire connector. To further protect the wire connector from the ingress of moisture and debris he points out that a gel is coated on the inside of his sleeve which he states can have heat activated properties to improve the bond with the insulation on his wires.

U.S. Pat. No. 6,619,996 disclose a water proof connector wherein a block of a high-viscosity gel is compressed to fill voids or gaps between terminals, wires and partitions. The gel is used to prevent the hot-melt material from excessively entering his gaps in his terminals.

U.S. Pat. No. 4,600,261 disclose an electrical connector wherein a gel material is in compressive contact with the electrical contacts with the gel encapsulating a conductive portion of the electrical contacts.

U.S. Pat. No. 5,405,520 shows a connector for banana plugs wherein a housing is filled with an electrophoresis gel that minimize or eliminate forces being transmitted back to his housing.

U.S. Pat. No. 5,339,100 disclose a transmission wire having a wire connector wherein a gel is placed around a contact member that is brought into contact with a live connector with the contact member positioned so that removal of the probe allows the contact member to return to its normal position in the presence of the self healing gel.

RE35,476 disclose a connector block for connecting drop wires to conducts of a multi-conductor cable wherein the wire support region is filed with a sealing gel.

U.S. Pat. No. 5,252,779 discloses a waterproof wire enclosure wherein a twist-on wire connector where the spliced connection is inserted into a capsule or cylinder where it is covered with a waterproofing compound, while he points out can be a gel or grease.

U.S. Pat. No. 5,886,111 discloses gel sealing materials for use in the back of automotive connectors for use in connectors which he states "exert a pressure on the gel greater than 5 psi, preferably greater then about 15 psi, and most preferably greater then about 25 psi."

U.S. Pat. No. 5,006,286 disclose a wire connector wherein the solder is replaced with a conductive gel with a heat shrink sleeve to prevent the conductor from being withdrawn from the sleeve.

Although the art is replete with wire connectors that are covered with a waterproof sealant and the use of a gel that is squeezed or compressed about an electrical connection the art has not recognized the benefit of use of a free standing or unsqueezed mass of a cohering gel or a mass of a self adhereable gel in a gel state the internal spiral thread of a twist-on wire connector wherein the wires are quickly brought into low resistance electrical contact with each other in the presence of the gel and the gel is allowed to self heal to form a protective covering over the wire ends in the twist-on wire connector. It has been found that since the wires in the twist-on wire connector form frictional and interlocking engagement with the spiral thread a free standing mass of cohering gel which adheres to the wire ends can remain in place to provide a protective covering without having to squeeze or compressively retain the gel in the twist-on wire connector. More significantly, it has been discovered that the use of a free standing mass of a cohering gel, which is neither a solid nor separable like sticky sealants but remains in a gel state, in a twist-on wire connector still allows one to quickly and efficiently encase a wire connection in a water resistant covering while also providing the advantage of allowing the gel covering to be quickly removed from the wire ends by hand peeling or hand stripping of the gel since the gel generally adheres to itself stronger than too the wire ends. It is pointed out that by free standing gel it is meant that the gel retains itself in the wire connector without the need of a compression housing around the gel.

SUMMARY OF THE INVENTION

A twist-on wire connector containing a free standing mass of a cohering gel which is in a gel state for forming a protective covering over a wire connection in the twist-on wire connector with the gel thereon characterized by being peelable removable from the twist-on wire connector ends of the wire connection to allow one to obtain clean wire ends that one can use quickly form a further wire connection.

DESCRIPTION OF THE PREFERRED EMBODIMENT

Figure 1:
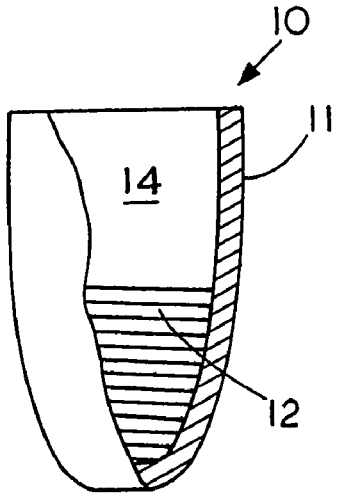
FIG. 1 PRIOR ART
FIG. 1 is a partial sectional view of a prior art twist-on wire connector.

FIG. 1 is a partial sectional view of a prior art twist-on wire connector 10 usable with the present invention. Twist-on wire connector 10 has an electrically insulated housing 11 and a spiral thread 12 secured to the insulated housing 11. The spiral thread engages the ends of wires and allows the wires to brought into electrical contact with each other by rotating the twist-on wire connector 10 with respect to the ends of the wires.

Figure 2:
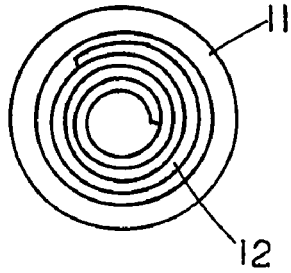
FIG. 2 PRIOR ART
FIG. 2 is a top view of a prior twist-on wire connector.

FIG. 2 is a top view of a prior art twist-on wire connector 10 of FIG. 1 showing the spiral thread 12 for engaging the wires located centrally within the electrically insulated housing 11.

Figure 3:
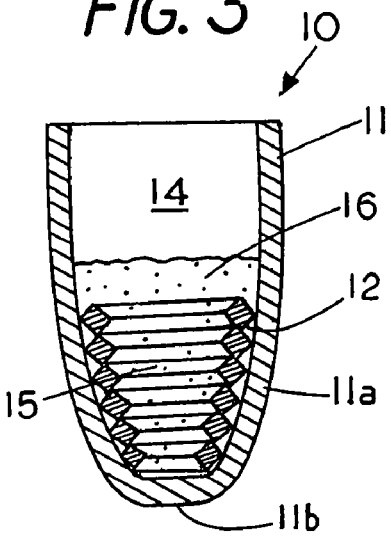
FIG. 3 is a sectional view of the prior art twist-on wire connector of FIG. 1 containing a mass of a cohering gel.

FIG. 3 is a section view of the prior art twist-on wire connector of FIG. 1 with a mass of a cohering gel 16 located therein. Twist-on wire connector 10 comprises an encircling sidewall 11*a* and an end wall 11*b* that mates with side wall 11*a* to form a chamber 14 within the electrically insulated housing 11. The spiral tread 12 is shown in cross section to reveal a wire cavity 15 for receiving ends of electrically wires. Located in wire cavity 15 is the mass of cohering gel 16 that is generally retained on the spiral thread 12 by the adhesion of the gel 16 to the spiral thread 15 and the interlocking engagement of the gel 16 with the spiral thread 15 to allow for handling and transporting of the twist-on wire connectors.

Figure 4:
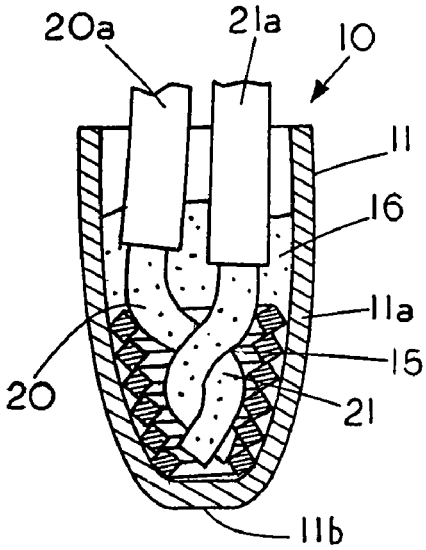
FIG. 4 is a section view of the twist-on wire connector of FIG. 3 with a plurality of wires formed into an electrical connection with a protective gel covering thereon.

FIG. 4 is a section view of the twist-on wire connector 10 of FIG. 3 having wire end 20 and a wire end 21 formed into an electrical connection in the wire cavity 15 with the mass of a cohering gel 16 covering the ends of the wire 20 and 21 and extending upward onto the electrical wire insulation covering 20*a* and 21*a* of wires 20 and 21. In this embodiment the ends of wires 20 and 21 have been twisted into electrical contact with each other in the presence of the mass of a cohering gel 16 which could be a gel providing dielectric insulation. Also during the twisting of the wires into electrical contact the adherence of the gel to the wires can cause the gel to follow along the wires resulting in additional insulation coating along the wire. This is particularly beneficial should the wire ends be over stripped as the gel can provide additional insulation to the areas of the wire that have been stripped.

It should be pointed out that the term gel is often used to refer to any of a number of different items which may or may not have a true gel state, that is a state that is neither solid liquid, or viscous but a state wherein the material yields when penetrated by a wire and then slowly flows around the wire to form a protective covering but when subject to a quick pulling force pulls apart in chunks and pieces.

Figure 5:
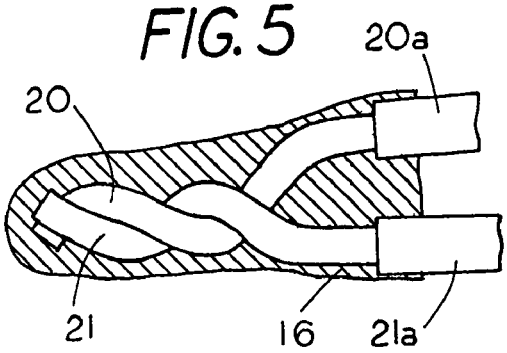
FIG. 5 is a partial section view shown the gel in section on the exterior of wire ends that have been removed from the wire connector of FIG. 4.
Figure 6:
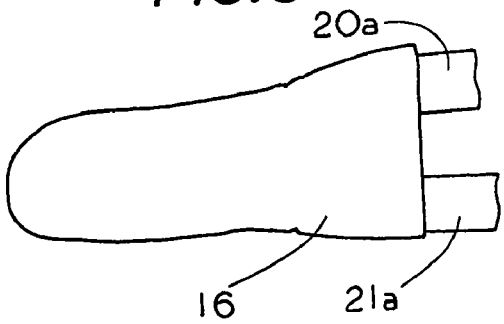
FIG. 6 shows the gel adhereable on the wire ends of the wires that have been removed form the twist-on wire connector of FIG. 6.
Figure 7:
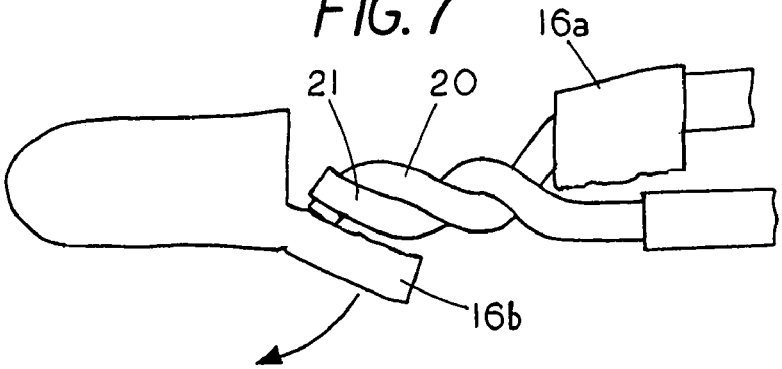
FIG. 7 shows the gel having been partially peeled from the ends of the wires.

To illustrate a benefit of the present invention when a wire connection has to be reformed for one reason or another reference should be made to FIG. 5 to FIG. 7.

FIG. 5 is a partial section view showing a mass of cohering gel 16 located on wire ends 20 and 21 that have been removed from the wire connector of FIG. 4. Note, FIG. 5 shows that the gel 16 can be at least partially retainable on the wire ends 20 and 21 when the wire ends are removed from the wire connector 10.

FIG. 6 shows a side view of the gel 16 that is still encasing or encapsulating a portion of wires 20*a* and 21*a*. That is, by slightly loosing the grip of the wires with respect to the thread 12 the wire ends can be removed which can cause all, none or part of the gel from remaining adhered to the wire ends. If an operator is to reform the wire connection formed by wires 20 and 21 or if another wire is to be added to the wire connection one needs to remove the gel 16 that encases and adheres to the wire ends 20 and 21. On the other hand if the gel remains in the twist-on wire connector the wires can be reinserted into the wire connector and the gel and twisted into electrical contact while the gel flows around the wire ends in the twist-on wire connector.

FIG. 7 shows that gel 16 has been torn apart by pulling on a portion of the gel (see arrow) that is, a user grasping gel can tear gel 16*b* into two or more parts. That is, the gel 16 in contrast to prior art sealants that are sticky the free standing mass of gel breaks or tears away when subject to a quick shearing force. While sticky sealants would separate and remains in a sticky condition on the wires regardless of how quickly the wire is removed, the gel in contrast adheres as a unit and separates by tearing if one quickly removes the wires from the gel.

FIG. 7 shows gel 16 has been torn into a first part 16*a* that is retained on the wires 20 and 21 and a second part 16*b* that peels away from wires 20 and 21. Note, since the gel is a cohering mass and lacks the continuous separable nature of a sticky sealant the gel can be neatly peeled away form the wires 20 and 21 leaving a clean surface on the wire ends 20 and 21. That is, as the adhesion of the gel to itself is greater than the adhesion of the gel to the wire ends the gel can be pulled away in chunks or lumps from the wire ends by overcoming the cohesive forces that hold the gel together. By having a gel that is characterized has having greater adhesion to itself than to the wire ends allows one to quickly peel the gel from the ends of a wire connection. On the other hand by having a gel with sufficient adhesion so as to normally retain itself on the wire ends allows the gel to form a protective covering over the wire ends to prevent moisture from contacting the wire ends.

Figure 8:
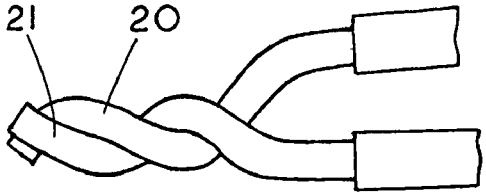
FIG. 8 shows the ends of the wires of FIG. 7 in a clean condition to provide for quick formation of another wire connection.

FIG. 8 shows the wire ends 21 and 20 in the clean condition after the remaining portion 16*a* of gel 16 has been peeled away. As the gel forms a cohering mass one can use one fingers to grasp and quickly pull chunks of the gel 16 away from the wires 20 and 21 to thereby bring the wire ends in a condition for reformation of an electrical connection.

Thus, although use of a cohering mass of gel 16 retained on the spiral thread 12, with the cohering mass of gel 16 being wire penetrateable and flowable as a plurality of wires 20 and 21 are inserted into the housing 11 and brought into electrical contact with each other one can form an electrical connection between wires 20 and 21 with a protective gel covering 16 on the plurality of wires (see FIG. 4). Because the gel has a plasticity, it will flow around the wire ends thereby sealing the wire ends from moisture or contamination. Although the gel 16 encased wire ends 20 and 21 can form a permanent connection one of field conditions that can occur is that an electrical connection may need to be reformed by adding or removing wires. If a solidifying agent such as epoxy or the like is used in the twist-on wire connector the wires must be cut and stripped in order to reform the connector. If a sticky sealant is used the wires need not be cut and striped but one needs to wipe the sticky sealant off the wires before attempting to secure another wire to the wires since the sticky sealant can get on the fingers and clothes of the user making a general mess. In the present invention, the use of a gel, which remains in a gel state is characterized by having self adherence to itself which is stronger than its adherence to the wire ends and which separate when subject to quick pulling force allows the gel to be quickly peeled away from the wire ends leaving the wire ends in a clean condition for reattachment.

Figure 9:
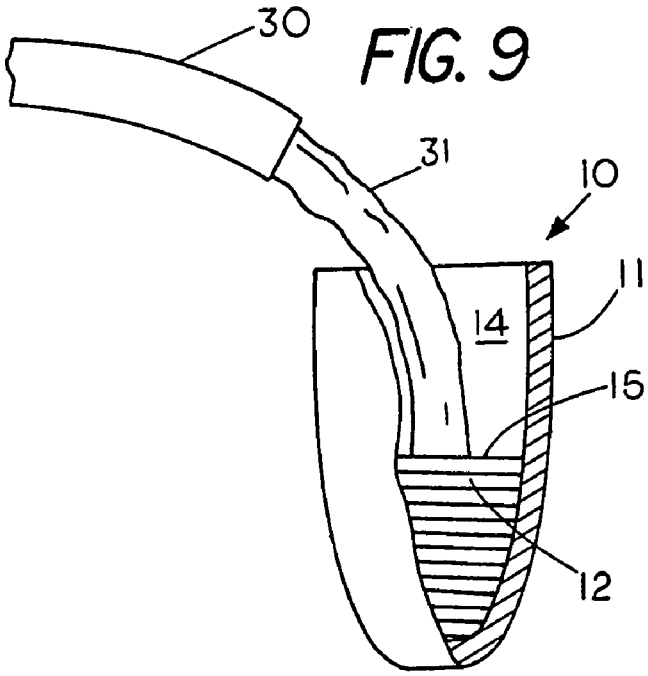
FIG. 9 shows an uncured gel in liquid form being poured into the chamber in an upright twist-on wire connector.

Thus the present invention includes the method of making a twist-on wire connector carrying a cohering mass of a self healing or flowable gel by forming an electrically insulated housing 11 having an end wall 11*b* and a sidewall 11*c* defining a chamber 14 having an open end and a closed end. One secures a spiral thread 12 having a wire cavity 15 in the electrically insulated housing 11. FIG. 9 shows a spout 30 pouring an uncured gel 31 in liquid form onto the chamber 14 and into the wire cavity 15 in the spiral thread while the housing 11 is in an upright condition to retain the uncured gel 31 in the wire cavity 15 and chamber 14.

Figure 10:
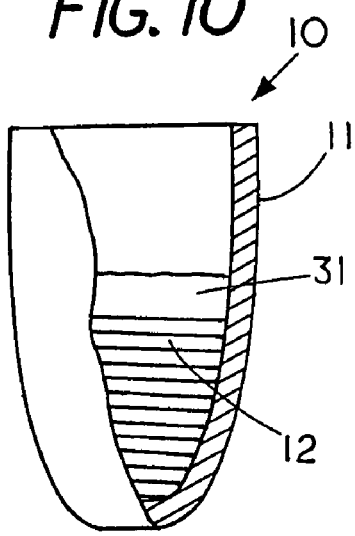
FIG. 10 shows the uncured gel in the twist-on wire connector or FIG. 9.

FIG. 10 shows the housing 11 in an upright condition with the liquid gel 31 in the uncured or self leveling state in the lower or closed end of housing 11. Next, one provides for insitu curing of the uncured gel 31 to form a cohering mass of self healing gel in the wire cavity as illustrated in FIG. 3.

FIG. 3 shows that as a result of curing one produces a free standing cohering mass of gel 16 retained in the wire cavity 15 at least partially by adhesion of the gel to the spiral thread 12 with the free standing cohering mass of gel 16 characterized by being wire penetrateable and flowable as a plurality of wires 20 and 21 (FIG. 4) are inserted into the housing 11 and brought into electrical contact with each other with the free standing cohering mass at least partially adhereable on the plurality of wires if the plurality of wires are removed from the chamber (FIG. 5) but removable from the plurality of wires by peeling the cohering mass or portions thereon away from the wires 20 and 21 (FIG. 7) to thereby free the wires from the gel to allow for immediate reconnection of wires 20 and 21 without having to wipe off or otherwise clean the wires. An example of a gel suitable in the present invention is a gel sold under the name Raychem Power Gel Sealant or Rhodia RTV 163.

Figure 11:
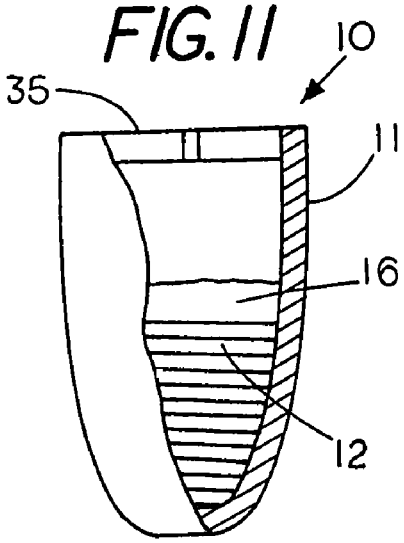
FIG. 11 shows the twist-on wire connector with a mass of cohering gel in the chamber of the connector and a cover extending over the open end of the insulated housing.

While the invention is suitable for twist-on wire connector with open ends the gel can be used in a twist-on wire connector with an end cap. FIG. 11 shows the twist-on wire connector housing 11 having an end cap 35 with segments thereon to allow a wire to penetrate the end cap and engage the gel 16 (called state) so the wires can be brought into electrical contact with each other.

While the use of a cohering mass of self healing gel that is water resistant can be used one may also want to use a gel that is flame retardant. A further advantage of use of the cohering mass of self healing which maintains itself in a flexible condition is that it inhibits formation of fissures along the interface between the wire and the gel during movement of an insulated wire housing with respect to the wire connector.

We claim:

1. A method of making a twist-on wire connector carrying a mass of cohering gel comprising;

forming an electrically insulated housing having an end wall and a sidewall defining a chamber having an open end and a closed end;

securing a spiral thread having a wire cavity in the electrically insulated housing;

pouring an uncured gel in a non-curing liquid form onto the wire cavity while the wire cavity is in an upright condition to retain the uncured gel in the wire cavity; and initiating an insitu curing of the uncured gel in the wire cavity to form a mass of a peelable cohering gel in a gel state in the wire cavity.

2. The method of claim 1 including the step of placing an end cap over the insulated housing.

3. The method of claim 1 including the step of forming a protective electrical covering by placing a set of wire ends in the twist-on wire connector with the mass of cohering gel and rotating the twist-on wire connector to bring the ends of the wires into electrical contact in the presence of the mass of cohering gel.

4. The method of claim 3 including the step of removing the wire ends from the spiral thread.

5. The method of claim 4 including the step of removing the mass of cohering gel from the wire ends that have been removed from the spiral thread by peeling the mass of cohering gel away from the wire ends.

6. The method of claim 5 wherein the mass of cohering gel is pulled away in chunks from the wire ends to provide the wire ends in a clean condition without having to wipe the wire ends.

7. The method of claim 6 wherein at least one of the wire ends in the clean condition is formed into an electrical connection without further cleaning of the wire ends.

8. A method of making a twist-on wire connector carrying a mass of cohering gel comprising:

forming an electrically insulated housing having an end wall and a sidewall defining a chamber having an open end and a closed end;

securing a spiral thread having a wire cavity in the electrically insulated housing;

placing an uncured gel in a non-curing liquid form in the wire cavity; and initiating an insitu curing of the uncured gel in the wire cavity to form a peelable mass of cohering gel in a gel state in the wire cavity before engaging a wire end with the spiral thread.

9. The method of claim 8 wherein an electrically insulating gel is placed in the wire cavity.

* * * * *